US006933904B2

(12) United States Patent
Honma

(10) Patent No.: US 6,933,904 B2
(45) Date of Patent: Aug. 23, 2005

(54) ANTENNA APPARATUS

(75) Inventor: Yukihiro Honma, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 136 days.

(21) Appl. No.: 10/406,288

(22) Filed: Apr. 4, 2003

(65) Prior Publication Data

US 2003/0193014 A1 Oct. 16, 2003

(30) Foreign Application Priority Data

Apr. 12, 2002 (JP) ..... 2002-111008
Feb. 26, 2003 (JP) ..... 2003-049559

(51) Int. Cl.[7] ..... H01Q 19/17
(52) U.S. Cl. ..... 343/781 P; 343/781 CA
(58) Field of Search ..... 343/781 P, 781 CA, 343/916

(56) References Cited

U.S. PATENT DOCUMENTS

| | | | | |
|---|---|---|---|---|
| 3,803,626 A | | 4/1974 | Garrett | 343/894 |
| 4,544,928 A | * | 10/1985 | Afifi et al. | 343/781 P |
| 4,755,826 A | * | 7/1988 | Rao | 343/781 P |
| 5,197,827 A | * | 3/1993 | Lee | 405/229 |
| 5,327,149 A | * | 7/1994 | Kuffer | 343/720 |
| 5,706,017 A | * | 1/1998 | Buttgenbach | 343/753 |

FOREIGN PATENT DOCUMENTS

| | | |
|---|---|---|
| GB | 1 382 094 | 1/1975 |
| JP | 3-3402 | 1/1991 |
| JP | 10-141922 | 5/1998 |

OTHER PUBLICATIONS

Patent Abstracts of Japan, JP 11–287650, Oct. 19, 1999.
M. Ishiguro, et al., "Measurements of Reflector Surface Accuracy for 45M Radio Telescope Based on Radio Holography Method", Mitsubishi Denki GIHO vol. 62, No. 5, 1988, 9 pages (with English Abstract).
T. Kurashima, "Structural Deformation Monitoring Using Reflectometry in Optical Fibers", Kogaku Japanese Journal of Optics, vol. 28, No. 3, Mar. 1999, 9 pages (with English Extract).

* cited by examiner

*Primary Examiner*—Wilson Lee
*Assistant Examiner*—Huedung X. Cao
(74) *Attorney, Agent, or Firm*—Oblon, Spivak, McClelland, Maier & Neustadt, P.C.

(57) ABSTRACT

An antenna apparatus detects a reflected light from a scattered light or from a reflector (40) mounted in an optical fiber (6,6*a*–6*d*), measures a strain generated in a primary reflecting mirror (1) and so on based on the scattered light or the reflected light, and calculates a reflector surface compensation data based on the strain of the primary reflecting mirror (1) and so on. An antenna driving section (11) is driven according to the reflector surface compensation data in order to compensate a direction of an antenna.

18 Claims, 5 Drawing Sheets

ANTENNA APPARATUS

BACKGROUND OF THE INVENTION

1. Field of the Invention

The present invention relates to an antenna apparatus capable of measuring and compensating deformation and displacement thereof, which requires a highly reflector surface accuracy, a highly directional accuracy, and a highly tracking accuracy in astronomical observation and communication fields.

2. Description of the Related Art

In a recent radio telescope field, there is a strong demand to use a high frequency wave such as a submillimeter wave instead of a millimeter wave, for example. In order to perform the radio telescope observation using a high frequency wave, it is necessary to increase the reflector surface accuracy and the directional accuracy of a beam. On the other hand, in order to increase the observation efficiency, the telescope uses a large diameter lens and it is hope that a person can perform the astronomical observation day or night regardless of weather. However, the use of a large diameter lens increases a deformation of the telescope by its own weight, and strong wind and solar radiation on a bright day increase a heat deformation and stress deformation of the telescope. It is thereby difficult to keep a high reflector surface accuracy of the reflecting mirror and a directional accuracy of the beam. In order to obtain the telescope which can realize those various demands, the high reflector surface accuracy, the directional accuracy, the large diameter of the lens, and the observation in day or night on all weather, it is necessary for the antennal apparatus to have a compensation system to measure and compensate the reflector surface accuracy and a directional error of the reflecting mirror of the telescope in real time.

FIG.7 is a diagram showing a configuration of a conventional antenna apparatus capable of measuring a reflector surface accuracy of a reflecting mirror antenna based on Radio holography method, generating a control signal, and compensating the reflector surface based on the control signal. This technique has been disclosed in a following Japanese document:

MEASUREMENTS OF REFLECTOR SURFACE ACCURACY FOR 45 m RADIO TELESCOPE BASED ON RADIO HOLOGRAPHY METHOD, M. Ishiguro, K. Morita, et al., vol.62, No.5, pages 69–74, 1988, MITSUBISHI DENKI GIHO, MITSUBISHI DENKI KABUSHIKI KAISHA.

In FIG. 7, reference number 19 designates a communication satellite, 20 denotes a beacon radio wave transmitted. form the communication satellite 19, and 1 indicates a primary reflecting mirror made up of a plurality of panel reflector surfaces to be measured in the reflector surface accuracy. Reference number 21 designates a primary focus horn for receiving a conversing radio wave reflected by the primary reflecting mirror 1, and 22 denotes a reference antenna in a standard of the reflector surface accuracy. Reference number 23 designates a two channel correlation receiver, to which a power is supplied from the primary focus horn 21 and the reference antenna 22, for performing a correlation process. Reference number 4 indicates a secondary reflecting mirror support section for supporting the receiver 23.

Reference number 24 designates an electric field radiation signal, transferred from the receiver 23, having amplitude and phase of the electric field on the reflector surface to be measured using the reference antenna reflector surface as a standard.

Reference number 25 indicates a telescope driving system, 26 designates a driving signal for the telescope, 27 denotes attitude data of the telescope, 28 indicates an electric field radiation signal, and 17 denotes a reflector surface error calculation section. Reference character 10*a* designates reflector surface compensation data. Reference number 13 denotes a reflector surface compensation driving section.

Next, a description will now be given of the operation of the conventional antenna apparatus.

The primary focus horn 21 and the reference antenna 22 receive the beacon radio wave 20 transmitted from the communication satellite 19. The two channel correlation receiver 23 performs the correlation of those received data, so that one-dimensional electric field radiation signal 28 of the primary reflector surface is obtained using the reference antenna 22 as the standard.

A space pattern of the electric field radiation signal 28 in two dimensions is obtained based on the attitude data 27 of the telescope and the electric field radiation signal 28 in its attitude by performing the same measurement in changing of the attitude (or position) of the telescope around the direction of the radio wave source. Because there is a relationship of Fourier transformation between the electric field radiation pattern and the electric field distribution of an opening surface, it is possible to calculate the electric field distribution of the opening surface of the reflector surface by performing Fourier transformation of the electric field radiation pattern. An error of the reflector surface to be measured is thereby calculated by multiplying the term of the phase in the electric field distribution of the opening surface with the wavelength. The reflector surface compensation driving section 13 compensates the reflector surface error.

FIG. 8 is a diagram showing a configuration of another conventional antenna apparatus capable of detecting an antenna directional error, which has been disclosed in a following Japanese patent document.

Japanese laid-open publication number H3-3402, for example.

In FIG. 8, reference number 1 designates a primary reflecting mirror. Reference character 2*a* designates an antenna mount section. Reference number 29 designates a AZ angle detector in the antenna, 30 denotes a EL angle detector in the antenna, and 31 indicates the same means of the EL angle detector 30 or the mount only having the same case of the EL angle detector 30.

Reference number 32 designates a pair of beam generators mounted on the upper section of the AZ angle detector 29 fixed on the antenna frame 5*a*, and 33 denotes a light position detector mounted on the mount 31, to which the beam generated by the beam generator 32 is irradiated. Reference number 34 designates a beam generator mounted on both the EL angle detector 30 and the mount 31, and 35 denotes a light position detector mounted on the AZ angle detector 29, to which the beam generated by the beam generator 34 is irradiated.

Those light position detectors 33 and 35 form two divided photo diodes mounted so as to detect a deviation of the beam in Y-axis direction.

Next, a description will now be given of the operation of the conventional antenna apparatus.

The deformation of the antenna frame 5*a* generates a twist around the axis and a parallel displacement. In the system shown in FIG. 8, a pair of the light position detectors 33 for AZ axis and a pair of the light position detectors 35 for EL axis are mounted. By calculating the output from both the detectors 33 and 35, the magnitude of the twist in each of AZ and EL axis is detected. Further, the detected magnitude of the twist in each axis is compensated by adding or subtracting it with the angle signal detected by the EL angle detector 30 and 31 and the AZ angle detector 29.

Because the conventional antenna apparatus has the configuration described above, there is a drawback in the prior art in which it must be necessary to introduce the different systems and measurement methods, as shown in FIG. 7 and FIG. 8, in order to measure the deformation of the mount section which causes the reflector surface error and the directional error. This requires much labor and also increases the cost of the antenna apparatus.

In addition, the conventional antenna apparatus shown in FIG. 7 involves another drawback which must require to perform the another radio wave holography observation using an artificial radio wave generator in order to measure the reflector surface error in addition to the astronomical observation. This conventional drawback decreases the operation efficiency for the antenna apparatus. Still further, the conventional antenna apparatus cannot operate in real time because it is difficult to compensate the deformation of the reflector surface caused by changing the amount of the sunlight and the wind and the attitude (or position) of the telescope at every moment during the astronomical observation.

Still furthermore, although the antenna angle detector in the conventional antenna apparatus shown in FIG. 8 can measure the directional error of the telescope beam when the twist of AZ axis and EL axis occurs by the deformation of the antenna frame, there is a problem that it is difficult to measure the directional error caused by the displacement of the primary reflecting mirror and the secondary reflecting mirror. In addition, in the system using the light position detector, there is a drawback that it is difficult to mount the light position detector in the place where no light beam reaches in the system using the light position detector. Therefore this drawback limits the place where the antenna is introduced and mounted.

SUMMARY OF THE INVENTION

The present invention has been made to solve the above drawbacks involved in the conventional antenna apparatus. It is therefore an object of the present invention to provide an antenna apparatus capable of measuring and compensating a deformation and a displacement of the antenna apparatus which requires a reflector surface accuracy, a directional accuracy, and a tracking accuracy in astronomical observation and communication fields.

To achieve the objects described above, the present invention provides an antenna apparatus, as one aspect, that has a primary reflecting mirror, a secondary reflecting mirror, secondary reflecting mirror support section, a back structure for the primary reflecting mirror, an antenna mount section, an optical fiber, a strain measuring section, a reflector surface error calculation section, and a reflector surface compensation section. In the antenna apparatus, the optical fiber for receiving a light is mounted in the primary reflecting mirror. The strain measuring section supplies a light to the optical fiber and detects a scattered light from the optical fiber and measures a strain generated in the primary reflecting mirror. The reflector surface error calculation section calculates reflector surface compensation data based on the strain generated in the primary reflecting mirror. The reflector surface compensation section compensates the reflector surface of the primary reflecting mirror based on the reflector surface compensation data.

BRIEF DESCRIPTION OF THE DRAWINGS

Other objects, features and advantages of the present invention will become apparent from the following description taken in conjunction with the accompanying drawings, in which.

DETAILED DESCRIPTION OF THE PREFERRED EMBODIMENTS

A detailed description will be given, with reference to the accompanying drawings, of the preferred embodiments of the present invention.

First Embodiment

Figure 1:
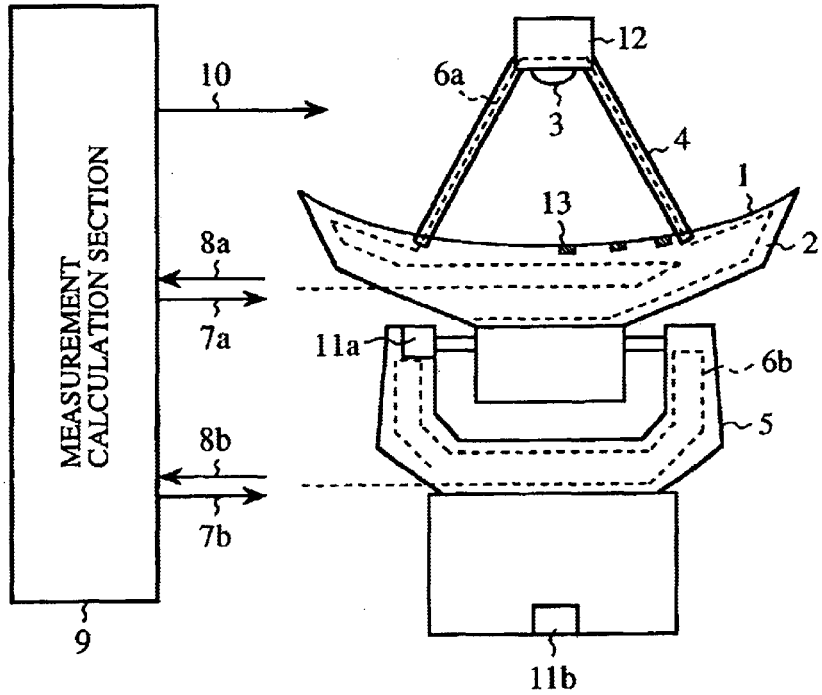
FIG. 1 is a conceptual system diagram showing the entire configuration of an antenna apparatus according to a first embodiment of the present invention.

FIG. 1 is a conceptual system diagram showing the entire configuration of an antenna apparatus according to a first embodiment of the present invention.

In FIG. 1, reference number 1 designates a primary reflecting mirror, 2 denotes a back structure which supports the primary reflecting mirror 1, 3 indicates a secondary reflecting mirror, 4 designates a secondary reflecting mirror support section, and 5 denotes an antenna mount section which supports the primary reflecting mirror 1 and other components. Reference character 6*a* designates an optical fiber mounted in the primary reflecting mirror 1, the back structure 2 for the primary reflecting mirror 1, and the secondary reflecting mirror support section 4. Reference character 6*b* denotes an optical fiber mounted in the antenna mount section 5.

Reference characters 7*a* and 7*b* designate an incident light which enters into the optical fibers 6*a* and 6*b*, and 8*a* and 8*b* indicate a scattered light generated in each optical fiber 6*a* and 6*b*. Reference number 9 designates measurement calculation section for calculating each error based on information of the incident lights 7*a* and 7*b* and the scattered lights 8*a* and 8*b*. Reference number 10 denotes data regarding the reflector surface error and the directional error calculated by the measurement calculation section 9. Reference character 11*a* designates a EL axis driving section, and 11*b* denotes a AZ axis driving section. Reference number 12 indicates a secondary reflecting mirror driving section, and 13 designates a reflector surface compensation driving section for compensating the reflector surface of the primary reflecting mirror 1.

Next, a description will now be given of the basic operation of the antenna apparatus according to the first embodiment.

First, the incident lights 7*a* and 7*b* such as a pulse light enter into the optical fibers 6*a* and 6*b*. During the transmission of those lights through the optical fibers 6*a* and 6*b*, the scattered lights 8*a* and 8*b* such as Brillouin scattered light are generated. Because a light strength shift amount P and a frequency shift amount Δf of the scattered lights 8*a* and 8*b* to the incident lights 7*a* and 7*b* have a correlation of the strains generated in the longitudinal direction of both the optical fibers 6*a* and 6*b*, the strain amounts of the optical fibers 6*a* and 6*b* by measuring those amounts P and Δf. The generation position of the scattered lights 8*a* and 8*b* is obtained by counting the time length t counted from the incident time of the incident lights 7*a* and 7*b* into the optical fibers 6*a* and 6*b* to the receiving time of the scattered lights 8*a* and 8*b* (hereinafter, referred to as arrival time).

The measurement calculation section 9 measures the generation and supply of the incident lights 7*a* and 7*b*, the light strength shift amount P of the scattered lights 8*a* and 8*b*, the frequency shift amount Δf, and the arrival time t, and then calculates the distribution of the strains of the optical fibers 6*a* and 6*b*, and the reflector surface error and the directional error are calculated using this distribution of the strains.

The directional error is compensated by driving the EL axis driving section 11*a*, the AZ axis driving section 11*b*, the secondary reflecting mirror driving section 12 so that the amount of each of the reflector surface error and the directional error is zero. In addition, the reflector surface error of the primary reflecting mirror 1 is compensated by driving the reflector surface compensation driving section 13.

Following, one example of the measurement calculation section 9 and each compensation mechanism will be explained.

Figure 2:
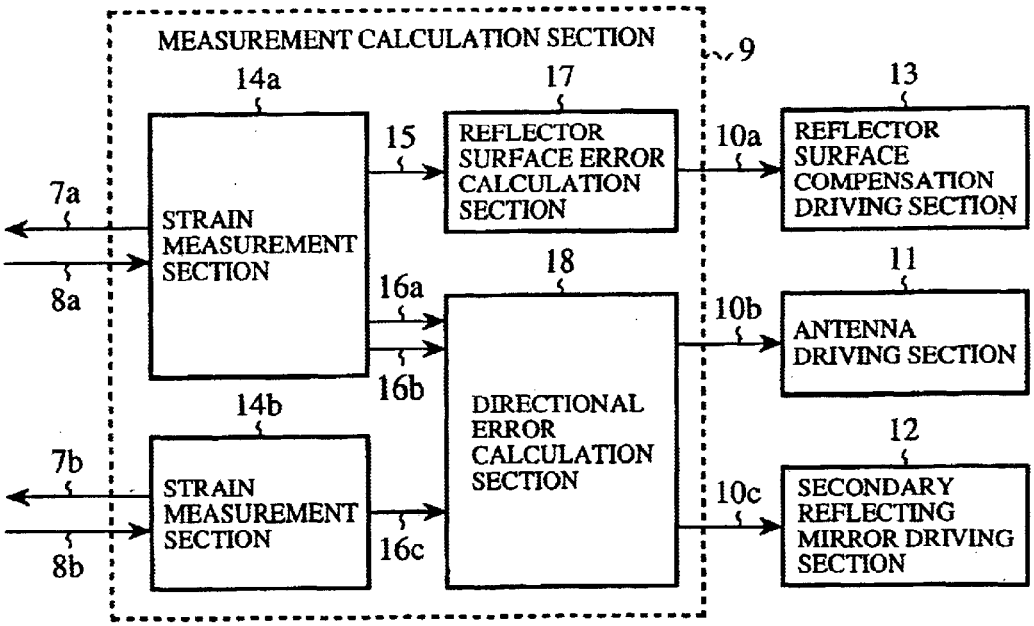
FIG. 2 is a block diagram showing a measurement calculation section in the antenna apparatus according to the first embodiment of the present invention.

FIG. 2 is a block diagram showing the configuration of the measurement calculation section 9 in the antenna apparatus according to the first embodiment of the present invention.

In FIG. 2, reference number 11 designates an antenna driving section made up of the EL driving section 11*a* and the AZ driving section 11*b*. Reference character 14*a* denotes a strain measurement section for measuring the strain of the optical fiber 6*a*, and 14*b* indicates a strain measurement section for measuring the strain of the optical fiber 6*b*. Reference number 15 designates the strain of the primary reflecting mirror 1. Reference character 16*a* denotes a strain of the back structure 2, 16*b* denotes a strain of the secondary reflecting mirror support section, and 16*c* indicates a strain of the antenna mount section 5. Reference number 17 designates a reflector surface error calculation section for calculating a shape error of the primary reflecting mirror 1. Reference number 18 designates a directional error calculation section for calculating the directional error of the antenna. Reference character 10*a* designates reflector surface compensation error data, 10*b* denotes antenna directional compensation data, and 10*c* indicates a position compensation data for the secondary reflecting mirror 3.

Next, a description will now be given of the operation of the antenna apparatus.

The strain measurement section 14*a* detects the light strength shift amount P, the frequency shift amount Δf, and the arrival time t of the scattered light 8*a*, and then calculates the strain 15*a* of the primary reflecting mirror 1, the strain 16*a* of the primary reflecting mirror back structure, and the strain 16*b* of the secondary reflecting mirror support section 4.

The strain measurement section 14*b* detects the light strength shift amount P, the frequency shift amount Δf, and the arrival time t of the scattered light 8*b*, and then calculates the strain 16*c* of the antenna mount section 5.

The reflector surface error calculation section 17 calculates the data 10*a* based on the strain 15 of the primary reflecting mirror 1. The driving section 13 compensates the reflector surface error based on the data from the reflector surface error calculation section 17. The directional error compensation section 18 calculates the antenna directional compensation data 10*b* and the compensation data 10*c* of the secondary reflecting mirror position based on the strains 16*a*, 16*b* and 16*c*. The antenna driving section 11 and the secondary reflecting mirror driving section 12 compensate the directional error based on those data 10*b* and 10*c*.

In the first example, although a pair of the strain measurement sections 14*a* and 14*b* are used, it is acceptable to commonly use a single strain measurement section instead of both the sections 14*a* and 14*b* by mounting an additional signal switching mechanism on the incident light incident section or the light receiving section.

As described above in detail, the antenna apparatus according to the first embodiment has following various configurations within the scope of the present invention.

The antenna apparatus has the primary reflecting mirror 1, the secondary reflecting mirror 3, the secondary reflecting mirror support section 4, the back structure 2 for the primary reflecting mirror 1, the antenna mount section 5, the optical fiber 6*a* mounted in the primary reflecting mirror 1, the strain measurement section 14*a*, the reflector surface error calculation section 17, and the reflector surface compensation driving section 13. The strain measurement section 14*a* provides the incident light 7*a* to the optical fiber, detects the scattered light 8*a* from the optical fiber, and thereby measures the strain 15 generated in the primary reflecting mirror 1. The reflector surface error calculation section 17 calculates the reflector surface compensation data 10*a* based on the strain 15 generated in the primary reflecting mirror 1. The reflector surface compensation driving section 13 compensates the reflector surface of the primary reflecting mirror 1 based on the reflector surface compensation data 10*a*.

Further, the antenna apparatus according to the first embodiment has the primary reflecting mirror 1, the secondary reflecting mirror 3, the secondary reflecting mirror support section 4, the back structure 2 for the primary reflecting mirror 1, the antenna mount section 5, the optical fiber 6*a* mounted in the secondary reflecting mirror support section 4, the strain measurement section 14*a*, the directional error calculation section 18, and the antenna driving section 11. The strain measurement section 14*a* provides the incident light 7*a* to the optical fiber, detects the scattered light 8*a* from the optical fiber, and thereby measures the strain 16*b* generated in the secondary reflecting mirror support section 4. The directional error calculation section 18 calculates the antenna directional compensation data 10*b* based on the strain 16*b* generated in the secondary reflecting mirror support section 4. The antenna driving section 11 compensates the direction of the antenna based on the antenna directional compensation data 10*b*.

Still further, the antenna apparatus according to the first embodiment has the primary reflecting mirror 1, the secondary reflecting mirror 3, the secondary reflecting mirror support section 4, the back structure 2 for the primary reflecting mirror 1, the antenna mount section 5, the optical fiber 6*a* mounted in the back structure 2 for the primary reflecting mirror 1, the strain measurement section 14*a*, the directional error calculation section 18, and the antenna driving section 11. The strain measurement section 14*a* provides the incident light 7*a* to the optical fiber, detects the scattered light 8*a* from the optical fiber, and thereby measures the strain 16*a* generated in the back structure 2. The directional error calculation section 18 calculates the antenna directional compensation data 10*b* based on the strain 16*a* generated in the back structure 2. The antenna driving section 11 compensates the direction of the antenna based on the antenna directional compensation data 10*b*.

Still furthermore, the antenna apparatus according to the first embodiment has the primary reflecting mirror 1, the secondary reflecting mirror 3, the secondary reflecting mirror support section 4, the back structure 2 for the primary reflecting mirror 1, the antenna mount section 5, the optical fiber 6*b* mounted in the antenna mount section 5, the strain measurement section 14*b*, the directional error calculation section 18, and the antenna driving section 11. The strain measurement section 14*b* provides the incident light 7*b* to the optical fiber, detects the scattered light 8*b* from the optical fiber, and thereby measures the strain 16*c* generated in the antenna mount section 5. The directional error calculation section 18 calculates the antenna directional compensation data 10*c* based on the strain 16*c* generated in the antenna mount section 5. The antenna driving section 11 compensates the direction of the antenna based on the antenna directional compensation data 10*b*.

Still moreover, the antenna apparatus according to the first embodiment has the structure components such as the primary reflecting mirror 1, the secondary reflecting mirror 3, the secondary reflecting mirror support section 4, the back structure 2 for the primary reflecting mirror 1, and the antenna mount section 5. The antenna apparatus of the first embodiment further has a combination made up of at least two of the following structures (A1), (B1), (C1), and (D1).

(A1) The optical fiber 6*a* mounted in the primary reflecting mirror 1, the strain measurement section 14*a*, the reflector surface error calculation section 17, and the reflector surface compensation driving section 13. The strain measurement section 14*a* provides the incident light 7*a* to the optical fiber, detects the scattered light 8*a* from the optical fiber, and thereby measures the strain 15 generated in the primary reflecting mirror 1. The reflector surface error calculation section 17 calculates the reflector surface compensation data 10*a* based on the strain 15 generated in the primary reflecting mirror 1. The reflector surface compensation driving section 13 compensates the reflector surface of the primary reflecting mirror 1 based on the reflector surface compensation data 10*a*.

(B1) The optical fiber 6*a* mounted in the secondary reflecting mirror support section 4, the strain measurement section 14*a*, the directional error calculation section 18, and the antenna driving section 11. The strain measurement section 14*a* provides the incident light 7*a* to the optical fiber, detects the scattered light 8*a* from the optical fiber, and thereby measures the strain 16*b* generated in the secondary reflecting mirror support section 4. The directional error calculation section 18 calculates the antenna directional compensation data based on the strain 16*b* generated in the secondary reflecting mirror support section 4. The antenna driving section 11 compensates the direction of the antenna based on the antenna directional compensation data 10*b*.

(C1) The optical fiber 6*a* mounted in the back structure 2, the strain measurement section 14*a*, the directional error calculation section 18, and the antenna driving section 11. The strain measurement section 14*a* provides the incident light 7*a* to the optical fiber, detects the scattered light 8*a* from the optical fiber, and thereby measures the strain 16*a* generated in the back structure 2. The directional error calculation section 18 calculates the antenna directional compensation data 10*b* based on the strain 16*a* generated in the back structure 2. The antenna driving section 11 compensates the direction of the antenna based on the antenna directional compensation data 10*b*.

(D1) The optical fiber 6*b* mounted in the antenna mount section 5, the strain measurement section 14*b*, the directional error calculation section 18, and the antenna driving section 11. The strain measurement section 14*b* provides the incident light 7*b* to the optical fiber, detects the scattered light 8*b* from the optical fiber, and thereby measures the strain 16*c* generated in the antenna mount section 5. The directional error calculation section 18 calculates the antenna directional compensation data 10*b* based on the strain 16*c* generated in the antenna mount section 5. The antenna driving section 11 compensates the direction of the antenna based on the antenna directional compensation data 10*b*.

In the antenna apparatus according to the first embodiment, the directional error calculation section 18 further calculates the secondary reflecting mirror position compensation data 10*c* for compensating the directional error supplementary, and the secondary reflecting mirror driving section 12 compensates the position of the secondary reflecting mirror based on this compensation data 10*c*.

Still furthermore, the antenna apparatus according to the first embodiment has the primary reflecting mirror 1, the secondary reflecting mirror 3, the secondary reflecting mirror support section 4, the back structure 2 for the primary reflecting mirror 1, the antenna mount section 5, the optical fibers 6*a* and 6*b*, the strain measurement sections 14*a* and 14*b*, the reflector surface error calculation section 13, the directional error calculation section 18, and the antenna driving section 11. The optical fiber 6*a* (as the first optical fiber) is mounted in the primary reflecting mirror 1, the secondary reflecting mirror support section 4, and the back structure 2. The optical fiber 6*b* (as the second optical fiber) is mounted in the antenna mount section 5. The strain measurement sections 14*a* and 14*b* provide the incident lights 7*a* and 7*b* to the optical fibers 6*a* and 6*b*, detect the scattered lights 8*a* and 8*b* from the optical fibers 6*a* and 6*b*, and thereby measure the strain 15 generated in the primary reflecting mirror 1, the strain 16*b* generated in the secondary reflecting mirror support section, the strain 16*a* generated in the back structure 2, the strain 16*c* generated in the antenna mount section 5. The reflector surface error calculation section 13 calculates the reflector surface compensation data 10*a* based on the strain 15 generated in the primary reflecting mirror 1. The directional error calculation section 18 calculates the antenna directional compensation data 10*b* based on the strain 16*b* generated in the secondary reflecting mirror support section 4, the strain 16*a* generated in the back structure 2, and the strain 16*c* generated in the antenna mount section 5. The antenna driving section 11 compensates the direction of the antenna based on the antenna directional compensation data 10*b*. The strain measurement section 14*a* provides the incident light to the first optical fiber 6*a*, detects the scattered light from the first optical fiber 6*a*, and measures the strain generated in the primary reflecting mirror 1, the strain generated in the secondary reflecting mirror support section 4, and the strain generated in the back structure 2. The strain measurement section 14*b* provides the incident light to the second optical fiber 6*b*, detects the scattered light from the second optical fiber 6*b*, and measures the strain generated in the antenna mount section 5.

The strain measurement sections 14*a* and 14*b* in the antenna apparatus according to the first embodiment measure the light strength shift amount P and the frequency shift amount Δf of the scattered lights 8*a* and 8*b* to the incident lights 7*a* and 7*b*, and the time length t from the incident time of the incident lights 7*a* and 7*b* into the optical fibers 6*a* and 6*b* to the arrival time of the scattered lights. Thereby, the strain measurement sections 14*a* and 14*b* measure the strain generated in the sections in which the optical fibers 6*a* and 6*b* are mounted.

As another configuration of the first embodiment, the first strain measurement section 14*a* measures the light strength shift amount P and the frequency shift amount Δf of the scattered light 8*a* to the incident light 7*a*, and the time length t counted from the incident time of the incident light 7*a* into the first optical fiber 6*a* to the arrival time of the scattered light. The strain measurement section 14*a* measures the strain generated in the section in which the first optical fiber 6*a* is mounted. Further, the second strain measurement section 14*b* measures the light strength shift amount P and the frequency shift amount Δf of the scattered light 8*b* to the incident light 7*b*, and the time length t counted from the incident time of the incident light 7*b* into the second optical fiber 6*b* to the arrival time of the scattered light. The strain measurement section 14*b* measures the strain generated in the section in which the second optical fiber 6*b* is mounted.

As described above, according to the first embodiment, the following effects can be obtained.

According to the first embodiment, because the information regarding the wavelength, the strength, and the arrival time of the scattered light are detected by entering the light into the optical fiber mounted in the primary reflecting mirror, it is possible to measure the directional error caused by the strain of the primary reflecting mirror in real time, and possible to calculate the reflector surface error of the primary reflecting mirror based on the strain. It is further possible to compensate the reflector surface error in real time by performing the feedback of the reflector surface error to the reflector surface compensation driving section. This can increase the operation efficiency of the telescope and the reliability of the reflector surface accuracy in attitude (or position) of the telescope mounted on the antenna apparatus at any time of day or night and all types of weather.

According to the first embodiment, because the information regarding the wavelength, the strength, and the arrival time of the scattered light are detected by entering the light into the optical fiber mounted in the secondary reflecting mirror support section, it is possible to measure the directional error caused by the displacement of the secondary reflecting mirror in real time, and thereby possible to increase the compensation accuracy of the directional error by performing the feedback of the directional error to the antenna driving section.

Still further, according to the first embodiment, because the strain distribution of each section of the optical fiber mounted in the primary reflecting mirror back structure is measured, it is possible to measure the directional error caused by the deformation of the primary reflecting mirror in real time, and further possible to increase the compensation accuracy of the directional error by performing the feedback of the directional error to the antenna driving section.

Moreover, according to the first embodiment, because the strain of the antenna mount section is measured using the optical fiber mounted in the antenna mount section, it is possible to calculate the directional error caused by the deformation of the antenna mount section. This can raise the limit for the mount position of the measuring devices and thereby enable to apply the measurement devices and the measuring method disclosed in this embodiment into the antennal apparatus of various types.

Furthermore, according to the first embodiment, because the secondary reflecting mirror driving section is mounted as the mechanism to compensate the directional error, it is possible to measure and compensate the directional error in a high frequency component, and thereby possible to compensate the directional error with high accuracy.

Still furthermore, according to the first embodiment, because the optical fiber and the strain measurement section are divided in position, it is possible to easily mount them in the antenna apparatus. Because the optical fibers can be mounted avoiding the areas of various driving section, it is possible to decrease occurrence of damage to the optical fibers as low as possible.

Still Furthermore, according to the first embodiment, because the light strength amount and the frequency shift amount of the scattered light to the incident light and the time from the incident time of the light to the arrival time of the scattered light are measured, it is possible to calculate the reflector surface error and the directional error.

Second Embodiment

Figure 3:
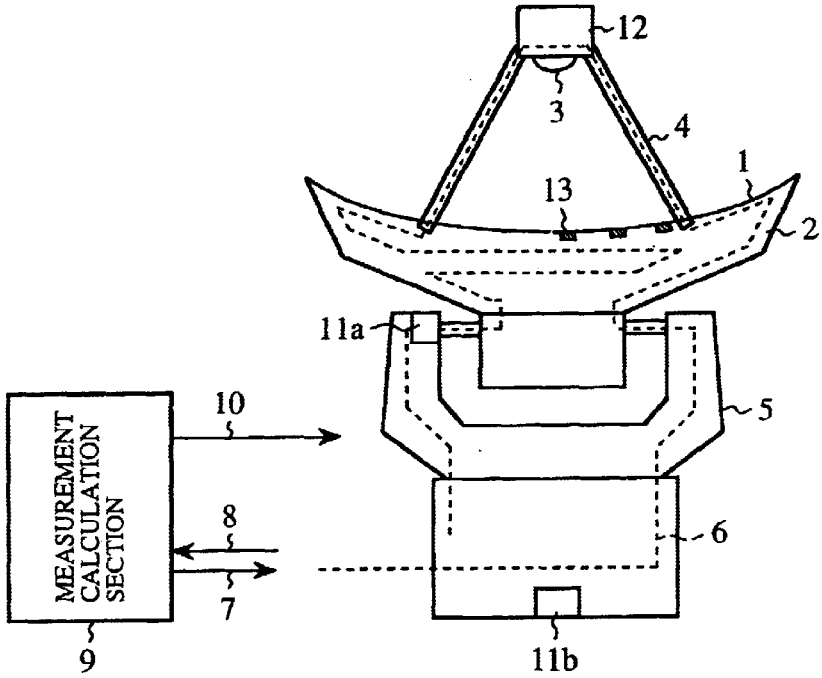
FIG. 3 is a conceptual system diagram showing the entire configuration of an antenna apparatus according to a second embodiment of the present invention.

FIG. 3 is a conceptual system diagram showing the entire configuration of an antenna apparatus according to a second embodiment of the present invention.

In FIG. 3, reference number 1 designates the primary reflecting mirror, 2 denotes the primary reflecting mirror back structure, 3 indicates the secondary reflecting mirror, 4 designates the secondary reflecting mirror support section, and 5 denotes the antenna mount section. Reference number 6 designates the optical fiber mounted in the primary reflecting mirror 1, the back structure 2 for the primary reflecting mirror 1, the secondary reflecting mirror support section 4, and the antenna mount section 5. Reference number 7 designates the incident light which enters into the optical fiber 6, and 8 indicates the scattered light generated in the optical fiber 6. Reference number 9 designates the measurement calculation section for calculating each error, and 10 denotes the data regarding the reflector surface error and the directional error calculated by the measurement calculation section 9. Reference character 11*a* designates the EL axis driving section, and 11*b* denotes the AZ axis driving section. Reference number 12 indicates the secondary reflecting mirror driving section, and 13 designates the reflector surface compensation driving section for compensating the reflector surface of the primary reflecting mirror 1.

Next, a description will now be given of the basic operation of the antenna apparatus according to the second embodiment.

First, the incident light 7 enters into the optical fiber 6. During the transmission of the light through the optical fiber 6, the light strength shift amount P and the frequency shift amount Δf of the scattered light 8 to the incident light 7, and the arrival time t of the scattered light are measured. The strain distribution is calculated using the information regarding those amounts P, Δf and "t". The reflector surface error and the directional error 10 of the antenna are calculated based on the strain distribution. The directional error is compensated by driving the EL axis driving section 11*a*, the AZ axis driving section 11*b*, the secondary reflecting mirror driving section 12 so that the reflector surface error and the directional error 10 are zero. In addition, the reflector surface error of the primary reflecting mirror 1 is compensated by driving the reflector surface compensation driving section 13.

Following, the measurement calculation section 9 and each compensation mechanism will be explained.

Figure 4:
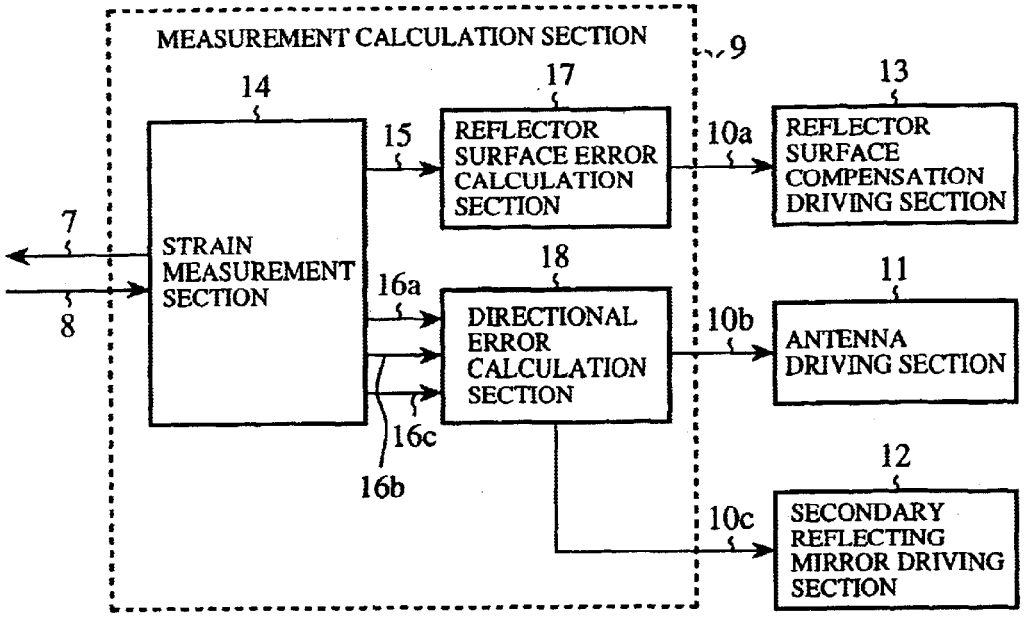
FIG. 4 is a block diagram showing a measurement calculation section in the antenna apparatus according to the second embodiment of the present invention.

FIG. 4 is a block diagram showing the measurement calculation section in the antenna apparatus according to the second embodiment of the present invention.

In FIG. 4, reference character 14 denotes a strain measurement section for measuring the strain of the optical fiber 6, and 15 designates the strain of the primary reflecting mirror 1. Reference character 16*a* denotes a strain of the back structure 2, 16*b* denotes a strain of the secondary reflecting mirror support section 4, and 16*c* indicates a strain of the antenna mount section 5. Reference number 17 designates the reflector surface error calculation section, and 18 designates the directional error calculation section. Reference character 10*a* designates reflector surface compensation error data, 10*b* denotes antenna directional compensation data, and 10*c* indicates a position compensation data for the secondary reflecting mirror.

Next, a description will now be given of the operation of the antenna apparatus.

The strain measurement section 14 detects the light strength shift amount P, the frequency shift amount Δf, and the arrival time t of the scattered light 8, and then calculates the strain 15 of the primary reflecting mirror 1, the strain 16*a* of the back structure 2, the strain 16*b* of the secondary reflecting mirror support section 4, and the strain 16*c* of the antenna mount section 5.

The reflector surface error calculation section 17 calculates the reflector surface error based on the strain 15 of the primary reflecting mirror 1, outputs the reflector surface compensation data to the reflector surface driving section 13 in order to compensate the reflector surface error. The directional error compensation section 18 calculates the antenna directional error based on the strain 16*a* of the back structure 2, the strain 16*b* of the secondary reflecting mirror support section 4, and the strain 16*c* of the antenna mount section 5. The antenna driving section 11 and the secondary reflecting mirror driving section 12 compensate the directional error based on the antenna directional compensation data 10*b* and the secondary reflecting mirror position compensation data 10*c*.

When compared with the configuration of the antenna apparatus of the first embodiment shown in FIG. 1 and FIG. 2, the antenna apparatus of the second embodiment shown in FIG. 3 and FIG. 4 has the advantage in manufacturing cost because the configuration of the second embodiment has a single optical fiber and a single strain measurement section instead of a pair of the optical fibers and a pair of the strain measurement sections. On the contrary, the configuration of the second embodiment needs to mount the optical fiber in the place of a relatively large area where the components of the antenna apparatus are rotated and driven. Although this configuration of the second embodiment has a possibility to cause a damage of the optical fiber, it is possible to easily avoid any occurrence of the damage from the optical fiber by mounting an, optical fiber loosing mechanism and a winding mechanism in this large area.

As described above in detail, the antenna apparatus according to the second embodiment has following various configurations within the scope of the present invention.

The antenna apparatus of the second embodiment has the primary reflecting mirror 1, the secondary reflecting mirror 3, the secondary reflecting mirror support section 4, the back structure 2, the antenna mount section 5, the optical fiber 6 mounted in the primary reflecting mirror 1, the strain measurement section 14, the reflector surface error calculation section 17, and the reflector surface compensation driving section 13. The strain measurement section 14 provides the incident light 7 to the optical fiber 6, detects the scattered light 8 from the optical fiber 6, and thereby measures the strain 15 generated in the primary reflecting mirror 1. The reflector surface error calculation section 17 calculates the reflector surface compensation data 10*a* based on the strain 15 generated in the primary reflecting mirror 1. The reflector surface compensation driving section 13 compensates the reflector surface of the primary reflecting mirror 1 based on the reflector surface compensation data 10*a*.

Further, the antenna apparatus of the second embodiment has the primary reflecting mirror 1, the secondary reflecting mirror 3, the secondary reflecting mirror support section 4, the back structure 2 for the primary reflecting mirror 1, the antenna mount section 5, the optical fiber 6 mounted in the secondary reflecting mirror support section 4, the strain measurement section 14, the directional error calculation section 18, and the antenna driving section 11. The strain measurement section 14 provides the incident light 7 to the optical fiber 6, detects the scattered light 8 from the optical fiber 6, and thereby measures the strain 16*b* generated in the secondary reflecting mirror support section 4. The directional error calculation section 18 calculates the antenna directional compensation data 10*b* based on the strain 16*b* generated in the secondary reflecting mirror support section 4. The antenna driving section 11 compensates the direction of the antenna based on the antenna directional compensation data 10*b*.

Still further, the antenna apparatus according to the second embodiment has the primary reflecting mirror 1, the secondary reflecting mirror 3, the secondary reflecting mirror support section 4, the back structure 2 for the primary reflecting mirror 1, the antenna mount section 5, the optical fiber 6 mounted in the back structure 2, the strain measurement section 14, the directional error calculation section 18, and the antenna driving section 11. The strain measurement section 14 provides the incident light 7 to the optical fiber 6, detects the scattered light 8 from the optical fiber 6, and thereby measures the strain 16*a* generated in the back structure 2. The directional error calculation section 18 calculates the antenna directional compensation data 10*b* based on the strain 16*a* generated in the back structure 2. The antenna driving section 11 compensates the direction of the antenna based on the antenna directional compensation data 10*b*.

Still furthermore, the antenna apparatus according to the second embodiment has the primary reflecting mirror 1, the secondary reflecting mirror 3, the secondary reflecting mirror support section 4, the back structure 2 for the primary reflecting mirror 1, the antenna mount section 5, the optical fiber 6 mounted in the antenna mount section 5, the strain measurement section 14, the directional error calculation section 18, and the antenna driving section 11. The strain measurement section 14 provides the incident light 7 to the optical fiber 6, detects the scattered light 8 from the optical fiber 6, and thereby measures the strain 16*c* generated in the antenna mount section 5. The directional error calculation section 18 calculates the antenna directional compensation data 10*b* based on the strain 16*c* generated in the antenna mount section 5. The antenna driving section 11 compensates the direction of the antenna based on the antenna directional compensation data 10*b*.

Still moreover, the antenna apparatus according to the second embodiment has the structure components such as the primary reflecting mirror 1, the secondary reflecting mirror 3, the secondary reflecting mirror support section 4, the back structure 2, and the antenna mount section 5. The antenna apparatus of the second embodiment further has a combination made up of at least two of the following structures (A2), (B2), (C2), and (D2).

(A2) The optical fiber 6 mounted in the primary reflecting mirror 1, the strain measurement section 14, the reflector surface error calculation section 17, and the reflector surface compensation driving section 13. The strain measurement section 14 provides the incident light 7 to the optical fiber 6, detects the scattered light 8 from the optical fiber 6, and thereby measures the strain 15 generated in the primary reflecting mirror 1. The reflector surface error calculation section 17 calculates the reflector surface compensation data 10*a* based on the strain 15 generated in the primary reflecting mirror 1. The reflector surface compensation driving section 13 compensates the reflector surface of the primary reflecting mirror 1 based on the reflector surface compensation data 10*a*.

(B2) The optical fiber 6 mounted in the secondary reflecting mirror support section 4, the strain measurement section 14, the directional error calculation section 18, and the antenna driving section 11. The strain measurement section 14 provides the incident light 7 to the optical fiber 6, detects the scattered light 8 from the optical fiber 6, and thereby measures the strain 16*b* generated in the secondary reflecting mirror support section 4. The directional error calculation section 18 calculates the antenna directional compensation data 10*b* based on the strain 16*b* generated in the secondary reflecting mirror support section 4. The antenna driving section 11 compensates the direction of the antenna based on the antenna directional compensation data 10*b*.

(C2) The optical fiber 6 mounted in the back structure 2 for the primary reflecting mirror 1, the strain measurement section 14, the directional error calculation section 18, and the antenna driving section 11. The strain measurement section 14 provides the incident light 7 to the optical fiber 6, detects the scattered light 8 from the optical fiber 6, and thereby measures the strain 16*a* generated in the back structure 2. The directional error calculation section 18 calculates the antenna directional compensation data 10*b* based on the strain 16*a* generated in the back structure 2. The antenna driving section 11 compensates the direction of the antenna based on the antenna directional compensation data 10*b*.

(D2) The optical fiber 6 mounted in the antenna mount section 5, the strain measurement section 14, the directional error calculation section 18, and the antenna driving section 11. The strain measurement section 14 provides the incident light 7 to the optical fiber 6, detects the scattered light 8 from the optical fiber 6, and thereby measures the strain 16*c* generated in the antenna mount section 5. The directional error calculation section 18 calculates the antenna directional compensation data 10*b* based on the strain 16*c* generated in the antenna mount section 5. The antenna driving section 11 compensates the direction of the antenna based on the antenna directional compensation data 10*b*.

In the antenna apparatus according to the second embodiment, the directional error calculation section 18 further calculates the secondary reflecting mirror position compensation data 10*c* for compensating the directional error supplementary, and the secondary reflecting mirror driving section 12 compensates the position of the secondary reflecting mirror 3 based on this compensation data 10*c*.

The strain measurement section 14 in the antenna apparatus according to the second embodiment measures the light strength shift amount P and the frequency shift amount $\Delta f$ of the scattered light 8 to the incident light 7, and the time length t counted from the incident time of the incident light 7 into the optical fiber 6 to the arrival time of the scattered light. Thereby, the strain measurement section 14 measures the strain generated in the sections in which the optical fiber 6 is mounted.

As set forth in detail, according to the second embodiment, the following effects can be obtained.

As described above, according to the first embodiment, the following effects can be obtained.

Because the information regarding the wavelength, the strength, and the arrival time of the scattered light are detected by entering the light into the optical fiber mounted in the primary reflecting mirror, it is possible to measure the directional error caused by the strain of the primary reflecting mirror in real time, and possible to calculate the reflector surface error of the primary reflecting mirror based on the strain. It is further possible to compensate the reflector surface error in real time by performing the feedback of the reflector surface error to the reflector surface compensation driving section. This operation can increase the operation efficiency of the telescope and the reliability of the reflector surface accuracy in attitude (or position) of the telescope mounted on the antenna apparatus at any time of day or night and all types of weather.

According to the second embodiment, because the information regarding the wavelength, the strength, and the arrival time of the scattered light are detected by entering the light into the optical fiber mounted in the secondary reflecting mirror support section, it is possible to measure the directional error caused by the displacement of the secondary reflecting mirror in real time, and thereby possible to increase the compensation accuracy of the directional error by performing the feedback of the directional error to the antenna driving section.

Still further, according to the second embodiment, because the strain distribution of each section of the optical fiber mounted in the primary reflecting mirror back structure is measured, it is possible to measure the directional error caused by the deformation of the primary reflecting mirror in real time, and further possible to increase the compensation accuracy of the directional error by performing the feedback of the directional error to the antenna driving section.

Moreover, according to the second embodiment, because the strain of the antenna mount section is measured using the optical fiber mounted in the antenna mount section, it is possible to calculate the directional error caused by the deformation of the antenna mount section. This can raises the limit for the mount position of the measuring devices and thereby enables to apply the measurement devices, and the measuring method disclosed in this embodiment into the antennal apparatus of various types. In addition, it is possible to measure the reflector surface accuracy and the directional error simultaneously by measuring the reflector surface error and the directional error using the single optical fiber and the single strain measurement section, which are commonly used, to the antenna mount section. This can obtain a simple system configuration of the antenna apparatus, and thereby increase the operation efficiency, and decrease the entire cost of the antenna apparatus, and the introduction time and labor of the antenna apparatus.

Furthermore, according to the second embodiment, because the secondary reflecting mirror driving section is mounted as the mechanism to compensate the directional error, it is possible to measure and compensate the directional error in a high frequency component, and thereby possible to compensate the directional error with high accuracy.

Still Furthermore, according to the second embodiment, because the amount of the light strength and the frequency shift amount of the scattered light to the incident light, and the time length counted from the incident time of the light to the arrival time of the scattered light are measured, it is possible to calculate the reflector surface error and the directional error.

Third Embodiment

Figure 5:
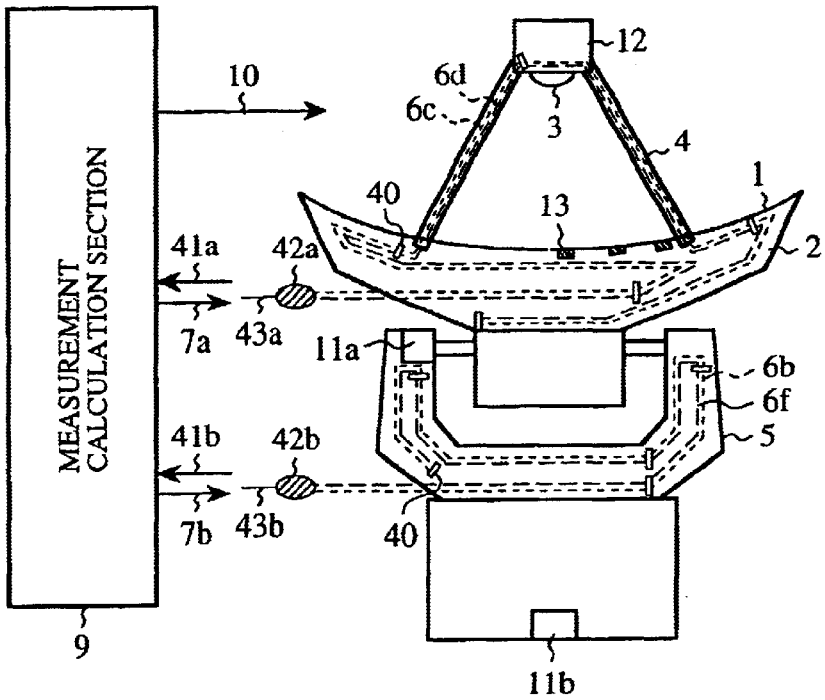
FIG. 5 is a conceptual system diagram showing the entire configuration of an antenna apparatus according to a third embodiment of the present invention.

FIG. 5 is a conceptual system diagram showing the entire configuration of an antenna apparatus according to a third embodiment of the present invention.

In FIG. 5, reference number 1 designates the primary reflecting mirror, 2 denotes the primary reflecting mirror back structure which supports the primary reflecting mirror 1, 3 indicates the secondary reflecting mirror, 4 designates the secondary reflecting mirror support section, and 5 denotes the antenna mount section which supports the primary reflecting mirror 1 and other components.

Reference character 6*c* designates an optical fiber (as a first optical fiber) for measuring a strain mounted in the back structure 2 for the primary reflecting mirror 1 and the secondary reflecting mirror support section 4.

Reference character 6*d* denotes a reference optical fiber (as a second optical fiber) mounted in the primary reflecting mirror 1, the back structure 2, and the secondary reflecting mirror support section 4. Reference character 6*e* indicates an optical fiber (as a third optical fiber) for measuring a strain mounted in the antenna mount section 5. Reference character 6*f* designates a reference optical fiber (as a fourth optical fiber) mounted in the antenna mount section 5. Reference number 40 denotes each reflector for reflecting a part of the incident light mounted at the tip portion of or in the optical fiber. Reference characters 42*a* and 42*b* designate optical couplers for optically connecting a pair of the optical fibers 6*c* and 6*d* or 6*e* and 6*f*. Reference characters 43*a* and 43*b* indicate input/output optical fibers through which the light enters into the optical couplers 42*a* and 42*b* and receive the light from the optical couplers 42*a* and 42*b*.

Reference characters 7*a* and 7*b* designate the incident lights which enter into the optical fibers, and 41*a* and 41*b* denote reflected lights reflected by the reflectors 40.

Reference number 9 designates the measurement calculation section for supplying the light to the optical fibers 7*a* and 7*b*, and calculating each error based on the reflected lights 41*a* and 41*b*.

Reference number 10 denotes the data regarding the reflector surface error and the directional error calculated by the measurement calculation section 9. Reference character 11*a* designates the EL axis driving section, and 11*b* denotes the AZ axis driving section. Reference number 12 indicates a secondary reflecting mirror driving section, and 13 designates the reflector surface compensation driving section for compensating the reflector surface of the primary reflecting mirror 1.

Next, a description will now be given of the basic operation of the antenna apparatus according to the third embodiment.

First, the incident light 7*a* enters into the optical fiber 43*a*. The incident light 7*a* is divided into two light parts by the optical coupler 42*a*. The divided lights are supplied to the optical fibers 6*c* and 6*d*, respectively. The optical fiber 6*c* for measurement is the optical fiber which is fixed to the structure body and deformed according to the deformation of the structure body. The reference optical fiber 6*d* is freely mounted and not deformed according to the deformation of the structure body. The incident light is transmitted through the optical fiber and a part thereof is reflected by the reflector 40 mounted in each section. The reflected light 41*a* enters into a Michelson interferometer. The optical path difference between the optical fiber for measurement and the reference optical fiber is detected based on the information of the peak position of an interference pattern detected when a movable mirror is shifted. The strain amount can be calculated based on the optical path difference. The same operation is performed for the incident light 7*b*, the optical fiber 43*b*, the optical coupler 42*b*, the optical fiber 6*e* for measurement, and the reference optical fiber 6*f*.

The measurement calculation section 9 detects the generation of the incident lights 7*a* and 7*b*, and the interference pattern generated by the reflected lights 41*a* and 41*b*, and then calculates the strain of each section in each optical fiber 6*a* and 6*b*, and also calculates the reflector surface error and the directional error 10 based on the strain distribution. The directional error is then compensated by driving the EL axis driving section 11*a*, the AZ axis driving section 11*b*, the secondary reflecting mirror driving section 12, and the reflector surface error caused in the primary reflecting mirror 1 is compensated by driving the reflector surface compensation driving section 13.

Following, one example of the measurement calculation section 9 and each compensation mechanism will be explained.

Figure 6:
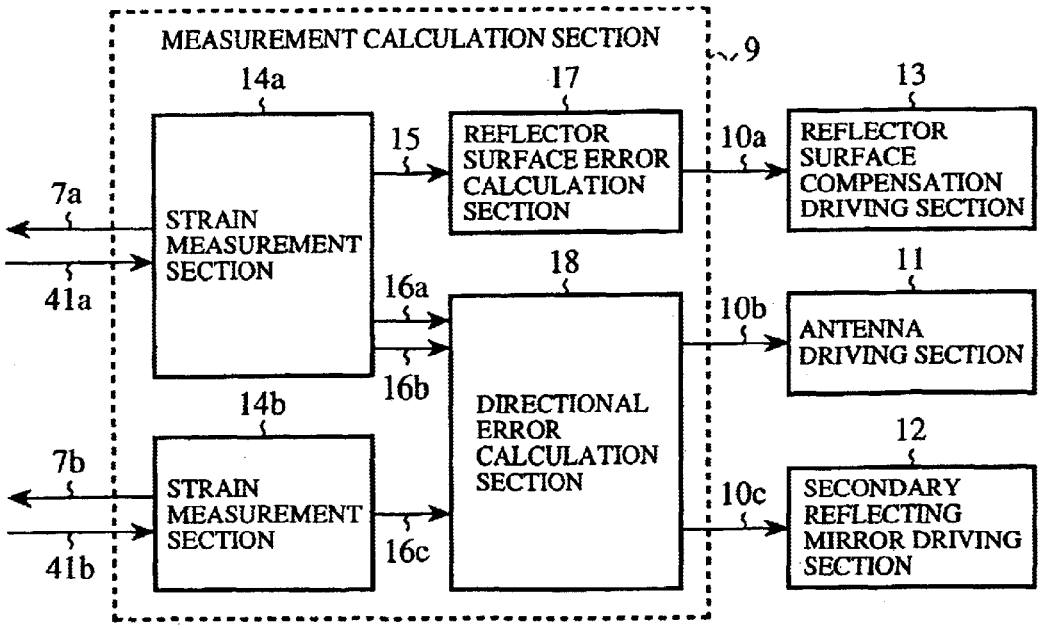
FIG. 6 is a block diagram showing a measurement calculation section in the antenna apparatus according to the third embodiment of the present invention.
Figure 7:
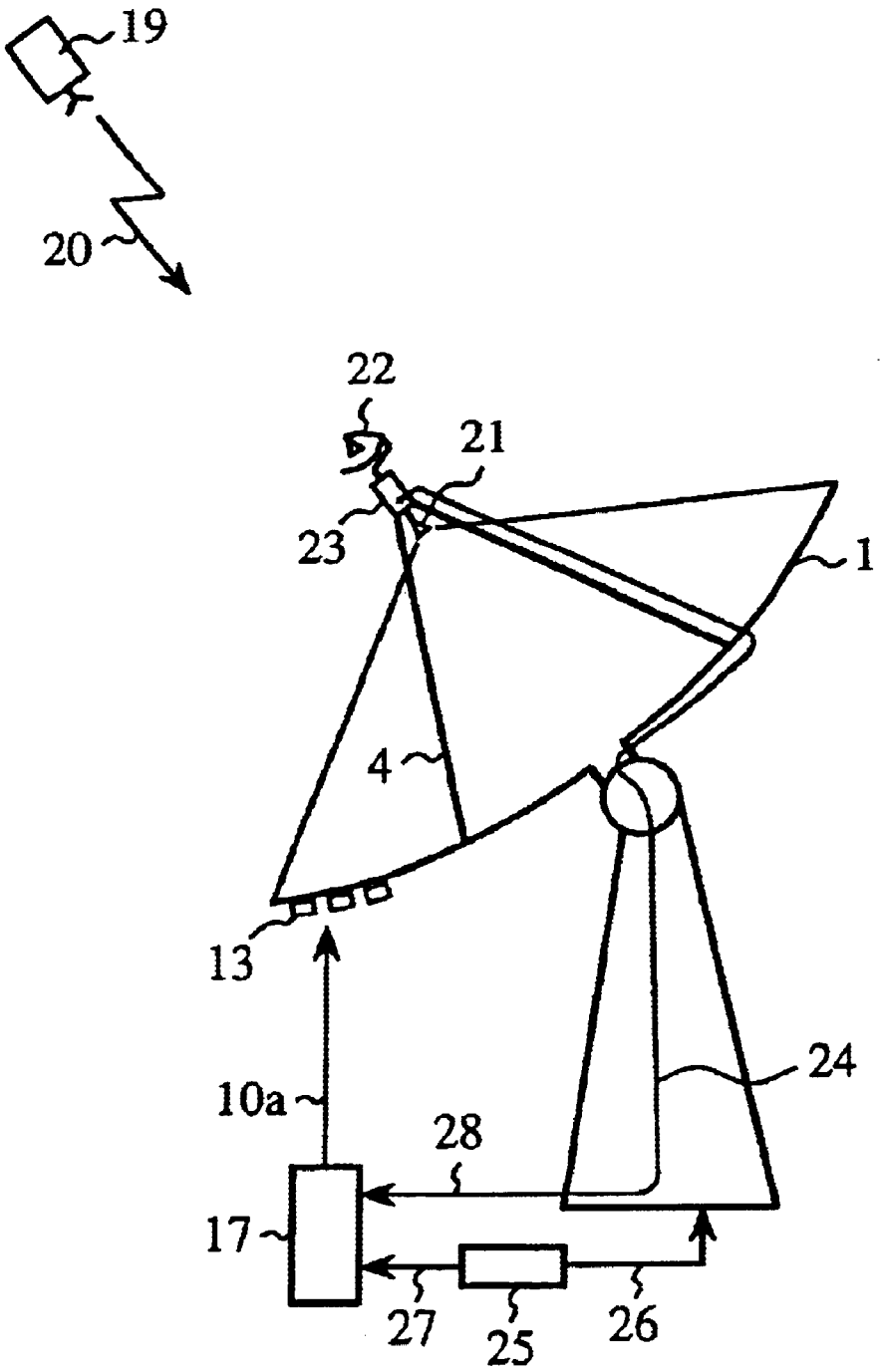
FIG.7 PRIOR ART
FIG. 7 is a diagram showing a configuration of a conventional antenna apparatus.
Figure 8:
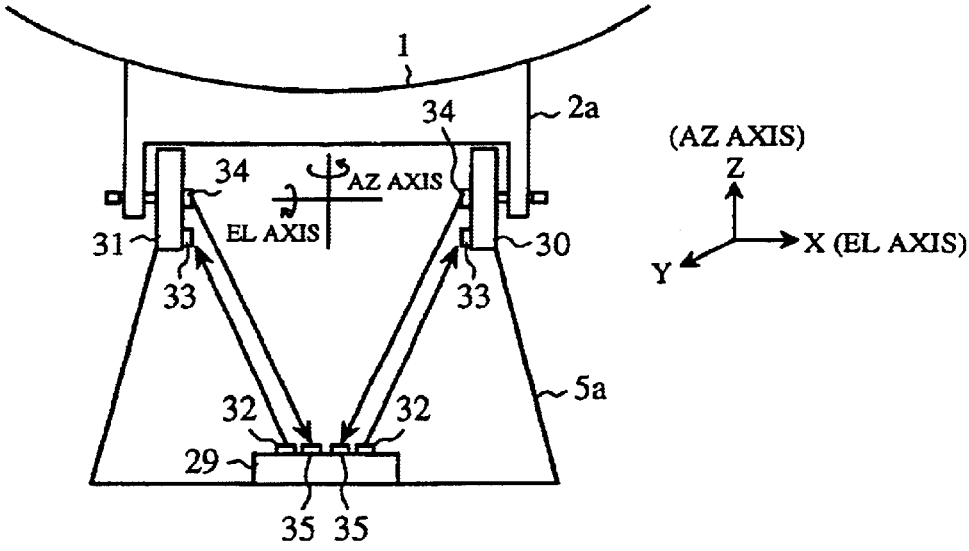
FIG.8 PRIOR ART
FIG. 8 is a diagram showing a configuration of another conventional antenna apparatus.

FIG. 6 is a block diagram showing a measurement calculation section in the antenna apparatus according to the third embodiment of the present invention. In FIG. 6, reference number 11 designates the antenna driving section. Reference character 14*a* denotes the strain measurement section for measuring the strain of the optical fiber 6*a*, 14*b* indicates the strain measurement section for measuring the strain of the optical fiber 6*b*. Reference number 15 designates the strain of the primary reflecting mirror 1. Reference character 16*a* denotes the strain of the back structure 2 for the primary reflecting mirror 1, 16*b* denotes a strain of the secondary reflecting mirror support section 4, and 16*c* indicates the strain of the antenna mount section 5. Reference number 17 designates the reflector surface error calculation section for calculating a shape error of the primary reflecting mirror 1. Reference number 18 designates the directional error calculation section for calculating the directional error of the antenna. Reference character 10*a* designates the reflector surface compensation error data, 10*b* denotes the antenna directional compensation data, and 10*c* indicates the position compensation data.

Next, a description will now be given of the operation of the antenna apparatus.

The strain measurement section 14*a* detects the peak position of the interference pattern generated by the reflected light 41*a*, and calculates the strain 16*a* of the primary reflecting mirror back structure and the strain 16*b* of the secondary reflecting mirror support section 4. The strain measurement section 14*b* detects the peak position of the interference pattern generated by the reflected light, and then calculates the strain 16*c* of the antenna mount section 5.

The reflector surface error calculation section 17 calculates the reflector surface compensation data 10*a* based on the strain 15 of the primary reflecting mirror 1. The reflector surface compensation driving section 13 compensates the reflector surface error based on the reflector surface compensation data 10*a*.

The directional error compensation section 18 calculates the antenna directional compensation data 10*b* and the compensation data 10*c* of the secondary reflecting mirror position based on the strains 16*a*, 16*b* and 16*c*. The antenna driving section 11 and the secondary reflecting mirror driving section 12 compensate the directional error based on those data.

In the third embodiment, a pair of the optical fibers 6*c* and 6*e*, a pair of the reference optical fibers 6*d* and 6*f*, and a pair of the strain measurement sections 14 are mounted in the primary reflecting mirror 1, the back structure 2 for the primary reflecting mirror 1, the secondary reflecting mirror support section 4, and the antenna mount section 5. The present invention is not limited by this configuration. For example, it is possible to mount optical fibers and corresponding strain measurement sections of not less than two in order to increase the detection accuracy of the interference pattern and to reduce the detection time to detect the peak position of the interference pattern.

In addition, it is possible to use the single strain measurement section which is commonly used when the signal switching mechanism is mounted at each of the incident section of the light and the light receiving section.

As described above in detail, the antenna apparatus according to the third embodiment has following various configurations within the scope of the present invention.

The antenna apparatus has the primary reflecting mirror 1, the secondary reflecting mirror 3, the secondary reflecting mirror support section 4, the back structure 2 for the primary reflecting mirror 1, the antenna mount section 5, a pair of the optical fibers 6*c* and 6*d* mounted in the primary reflecting mirror 1, the strain measurement section 14*a*, the reflector surface error calculation section 17, and the reflector surface compensation driving section 13. The strain measurement section 14*a* provides the incident light 7*a* to the optical fiber, and measures the strain 15 generated in the primary reflecting mirror 1 using the reflected light 41*a* from the reflector 40 mounted in the optical fiber. The reflector surface error calculation section 17 calculates the reflector surface compensation data 10*a* based on the strain 15 generated in the primary reflecting mirror 1. The reflector surface compensation driving section 13 compensates the reflector surface of the primary reflecting mirror 1 based on the reflector surface compensation data 10*a*.

Further, the antenna apparatus according to the third embodiment has the primary reflecting mirror 1, the secondary reflecting mirror 3, the secondary reflecting mirror support section 4, the back structure 2, the antenna mount section 5, a pair of the optical fibers 6*c* and 6*d* mounted in the secondary reflecting mirror support section 4, the strain measurement section 14*a*, the directional error calculation section 18, and the antenna driving section 11. The strain measurement section 14*a* provides the incident light 7*a* to the optical fiber, and measures the strain 16*b* generated in the secondary reflecting mirror support section 4 using the reflected light 41*a* from the reflector 40 mounted in the optical fiber. The directional error calculation section 18 calculates the antenna directional compensation data 10*b* based on the strain 16*b* generated in the secondary reflecting mirror support section 4. The antenna driving section 11 compensates the direction of the antenna based on the antenna directional compensation data 10*b*.

Still further, the antenna apparatus according to the third embodiment has the primary reflecting mirror 1, the secondary reflecting mirror 3, the secondary reflecting mirror support section 4, the back structure 2, the antenna mount section 5, a pair of the optical fibers 6*c* and 6*d* mounted in the back structure 2, the strain measurement section 14*a*, the directional error calculation section 18, and the antenna driving section 11. The strain measurement section 14*a* provides the incident light 7*a* to the optical fiber, and measures the strain 16*a* generated in the back structure 2 using the reflected light 41*a* from the reflectors 40 mounted in the optical fiber. The directional error calculation section 18 calculates the antenna directional compensation data 10*b* based on the strain 16*a* generated in the back structure 2. The antenna driving section 11 compensates the direction of the antenna based on the antenna directional compensation data 10*b*.

Still furthermore, the antenna apparatus according to the third embodiment has the primary reflecting mirror 1, the secondary reflecting mirror 3, the secondary reflecting mirror support section 4, the back structure 2 for the primary reflecting mirror 1, the antenna mount section 5, a pair of the optical fibers 6*e* and 6*f* mounted in the antenna mount section 5, the strain measurement section 14*b*, the directional error calculation section 18, and the antenna driving section 11. The strain measurement section 14*b* provides the incident light 7*a* to the optical fiber, and measures the strain 16*c* generated in the antenna mount section 5 using the reflected light 41*a* from the reflector 40 mounted in the optical fiber. The directional error calculation section 18 calculates the antenna directional compensation data 10*b* based on the strain 16*c* generated in the antenna mount section 5. The antenna driving section 11 compensates the direction of the antenna based on the antenna directional compensation data 10*b*.

Still moreover, the antenna apparatus according to the third embodiment has the structure components such as the primary reflecting mirror 1, the secondary reflecting mirror 3, the secondary reflecting mirror support section 4, the back structure 2, and the antenna mount section 5. The antenna apparatus of the third embodiment further has a combination made up of at least two of the following structures (A3), (B3), (C3), and (D3).

(A3) The optical fibers 6*c* and 6*d* mounted in the primary reflecting mirror 1, the strain measurement section 14*a*, the reflector surface error calculation section 17, and the reflector surface compensation driving section 13. The strain measurement section 14*a* provides the incident light 7*a* to the optical fiber, and measures the strain 15 generated in the primary reflecting mirror 1 using the reflected light 41*a* from the reflector 40 mounted in the optical fiber. The reflector surface error calculation section 17 calculates the reflector surface compensation data 10*a* based on the strain 15 generated in the primary reflecting mirror 1. The reflector surface compensation driving section 13 compensates the reflector surface of the primary reflecting mirror 1 based on the reflector surface compensation data 10*a*.

(B3) The optical fibers 6*c* and 6*d* mounted in the secondary reflecting mirror support section 4, the strain measurement section 14*a*, the directional error calculation section 18, and the antenna driving section 11. The strain measurement section 14*a* provides the incident light 7*a* to the optical fiber, and measures the strain 16*b* generated in the secondary reflecting mirror support section 4 using the reflected light 41*a* from the reflector 40 mounted in the optical fiber. The directional error calculation section 18 calculates the antenna directional compensation data 10*b* based on the strain 16*b* generated in the secondary reflecting mirror support section 4. The antenna driving section 11 compensates the direction of the antenna based on the antenna directional compensation data 10*b*.

(C3) The optical fibers 6*c* and 6*d* mounted in the back structure 2 for the primary reflecting mirror 1, the strain measurement section 14*a*, the directional error calculation section 18, and the antenna driving section 11. The strain measurement section 14*a* provides the incident light 7*a* to the optical fiber, and measures the strain 16*a* generated in the back structure 2 using the reflected light 41*a* from the reflector 40 mounted in the optical fiber. The directional error calculation section 18 calculates the antenna directional compensation data 10*b* based on the strain 16*a* generated in the back structure 2. The antenna driving section 11 compensates the direction of the antenna based on the antenna directional compensation data 10*b*.

(D3) The optical fibers 6*e* and 6*f* mounted in the antenna mount section 5, the strain measurement section 14*b*, the directional error calculation section 18, and the antenna driving section 11. The strain measurement section 14*b* provides the incident light 7*b* to the optical fiber, and measures the strain 16*c* generated in the antenna mount section 5 using the reflected light 41*b* from the reflector 40 mounted in the optical fiber. The directional error calculation section 18 calculates the antenna directional compensation data 10*b* based on the strain 16*c* generated in the antenna mount section 5. The antenna driving section 11 compensates the direction of the antenna based on the antenna directional compensation data 10*b*.

In the antenna apparatus according to the third embodiment, the directional error calculation section 18 further calculates the secondary reflecting mirror position compensation data 10*c* for compensating the directional error supplementary, and the secondary reflecting mirror driving section 12 compensates the position of the secondary reflecting mirror based on this compensation data 10*c*.

Still furthermore, the antenna apparatus according to the third embodiment has the primary reflecting mirror 1, the secondary reflecting mirror 3, the secondary reflecting mirror support section 4, the back structure 2 for the primary reflecting mirror 1, the antenna mount section 5, the optical fibers 6*c*, 6*d*, 6*e*, and 6*f*, the strain measurement sections 14*a* and 14*b*, the reflector surface error calculation section 13, the directional error calculation section 18, and the antenna driving section 11. The optical fibers 6*c*, 6*d*, 6*e*, and 6*f* are mounted in the primary reflecting mirror 1, the secondary reflecting mirror support section 4, and the back structure 2, and the antenna mount section 5. The strain measurement sections 14*a* and 14*b* provide the incident lights 7*a* and 7*b* to the optical fibers, and measure the strain 15 generated in the primary reflecting mirror 1, the strain 16*b* generated in the secondary reflecting mirror support section 4, the strain 16*a* generated in the back structure 2, and the strain 16*c* generated in the antenna mount section 5 using the reflected lights 41*a* and 41*b* from the reflectors 40 in the optical fibers. The reflector surface error calculation section 13 calculates the reflector surface compensation data 10*a* based on the strain 15 generated in the primary reflecting mirror 1. The directional error calculation section 18 calculates the antenna directional compensation data 10*b* based on the strain 16*b* generated in the secondary reflecting mirror support section 4, the strain 16*a* generated in the back structure 2, and the strain 16*c* generated in the antenna mount section 5. The antenna driving section 11 compensates the direction of the antenna based on the antenna directional compensation data 10*b*.

The optical fiber system comprises a pair of the first optical fibers 6*c* and 6*d* and a pair of the second optical fibers 6*e* and 6*f*. A pair of the first optical fibers 6*c* and 6*d* is mounted in the primary reflecting mirror 1, the back structure 2 for the primary reflecting mirror 1, and the secondary reflecting mirror support section 4. A pair of the second optical fibers 6*e* and 6*f* is mounted in the antenna mount section 5.

The first strain measurement section 14*a* provides the incident light to the first optical fibers, and measures the strains generated in the primary reflecting mirror 1, the strain generated in the secondary reflecting mirror support section 4, and the strain generated in the back structure 2 using the reflected light 41*a* from the reflector 40 mounted in the first optical fibers 6*c* and 6*d*. The second strain measurement section 14*b* provides the incident light to the second optical fibers, and measures the strain generated in the antenna mount section 5 using the reflected light 41*b* from the reflector 40 mounted in the second optical fibers 6*e* and 6*f*.

As described above, according to the third embodiment, the following effects can be obtained.

The light enters into the optical fibers for measurement and the reference optical fibers mounted in the primary reflecting mirror, the strain of the primary reflecting mirror is calculated by detecting the peak position of the interference pattern generated by the reflected light from the reflectors mounted in those optical fibers, and the reflector surface error of the primary reflecting mirror is calculated based on the strain thereof. It is therefore possible to compensate the reflector surface error in real time by performing the feedback of the reflector surface error to the reflector surface compensation driving section. This operation can increase the operation efficiency of the telescope and the reliability of the reflector surface accuracy in attitude (or position) of the telescope mounted on the antenna apparatus at any time of day or night and all types of weather.

According to the third embodiment, the light enters into both the optical fibers for measurement and the reference optical fibers mounted in the secondary reflecting mirror support section, the strain of the primary reflecting mirror is calculated and the directional error caused by the displacement of the secondary reflecting mirror is measured in real time by detecting the peak position of the interference pattern generated by the reflected light from the reflectors mounted in those optical fibers. It is therefore possible to increase the compensation accuracy of the directional error by performing the feedback of the directional error to the antenna driving section.

Still further, according to the third embodiment, because the strain distribution of each section of the optical fibers for measurement and the reference optical fibers mounted in the primary reflecting mirror back structure is measured, it is possible to measure the directional error caused by the deformation of the primary reflecting mirror back structure in real time, and further possible to increase the compensation accuracy of the directional error by performing the feedback of the directional error to the antenna driving section.

Moreover, according to the third embodiment, because the strain of the antenna mount section is measured using the optical fibers for measurement and the reference optical fibers mounted in the antenna mount section, it is possible to calculate the directional error caused by the deformation of the antenna mount section. This can raise the limit for the mount position of the measuring devices and thereby enable to apply the measurement devices and the method disclosed in this embodiment into the antennal apparatus of various types.

Furthermore, according to the third embodiment, because the secondary reflecting mirror driving section is mounted as the mechanism to compensate the directional error, it is possible to measure and compensate the directional error in a high frequency component, and thereby possible to compensate the directional error with high accuracy.

Still furthermore, according to the third embodiment, because the section of the optical fibers and the strain measurement section are divided in position, it is possible to easily mount them in the antenna apparatus. Because the optical fibers can be mounted avoiding the area of the various driving section, it is possible to decrease occurrence of damage to the optical fibers as low as possible.

As set forth in detail, according to the present invention, the following effects can be obtained.

Because the information regarding the wavelength, the strength, and the arrival time of the scattered light are detected by entering the light to the optical fiber mounted in the primary reflecting mirror, it is possible to measure the directional error caused by the strain of the primary reflecting mirror in real time, and possible to calculate the reflector surface error of the primary reflecting mirror based on this strain. It is further possible to compensate the reflector surface error in real time by performing the feedback of the reflector surface error to the reflector surface compensation driving section. This operation can increase the operation efficiency of the telescope and the reliability of the reflector surface accuracy in attitude (or position) of the telescope mounted on the antenna apparatus at any time of day or night and all types of weather.

According to the present invention, because the information regarding the wavelength, the strength, and the arrival time of the scattered light are detected by entering the light to the optical fiber mounted in the secondary reflecting mirror support section, it is possible to measure the directional error caused by the displacement of the secondary reflecting mirror in real time, and thereby possible to increase the compensation accuracy of the directional error by performing the feedback of the directional error to the antenna driving section.

Still further, according to the present invention, because the distribution of the.primary reflecting mirror back structure is measured using the optical fiber mounted in the primary reflecting mirror back structure, it is possible to measure the directional error caused by the deformation of the primary reflecting mirror in real time, and further possible to increase the compensation accuracy of the directional error by performing the feedback of the directional error to the antenna driving section.

Moreover, according to the present invention, because the strain of the antenna mount section is measured using the optical fiber mounted in the antenna mount section, it is possible to calculate the directional error caused by the deformation of the antenna mount section. This can raise the limit for the mount position of the measuring devices and thereby enable to apply the measurement devices and the method of the present invention to the antennal apparatus of various types. In addition, by measuring the reflector surface error and the directional error are measured using the common optical fiber and the strain measurement section mounted in the antenna mount section, it is possible to measure the reflector surface error and the directional error simultaneously. This can obtain a simple system configuration of the antenna apparatus, and thereby increase the operation efficiency, and decrease the entire cost of the antenna apparatus, and the introduction time and labor of the antenna apparatus.

Furthermore, according to the present invention, because the secondary reflecting mirror driving section is mounted as the mechanism to compensate the directional error, it is possible to measure and compensate the directional error in a high frequency component, and thereby possible to compensate the directional error with high accuracy.

Still furthermore, according to the present invention, because the optical fibers and the strain measurement sections are divided in position, it is possible to easily mount them in the antenna apparatus. Because the optical fibers can be mounted avoiding the areas of various driving section, it is possible to decrease occurrence of damage to the optical fibers as low as possible.

According to the present invention, the light enters into a pair of the optical fibers mounted in the primary reflecting mirror, the strain of each structural component is obtained by detecting the peak position of the interference pattern using the reflected light from the reflectors mounted in the tip of or in the optical fibers. It is thereby possible to measure the strain of the primary reflecting mirror in real time and to calculate the reflector surface error of the primary reflecting mirror based on the strain. It is therefore possible to compensate the reflector surface error in real time by performing the feedback of the reflector surface error to the reflector surface compensation driving section. This operation can increase the operation efficiency of the telescope and the reliability of the reflector surface accuracy in attitude (or position) of the telescope mounted on the antenna apparatus at any time of day or night and all types of weather.

According to the present invention, the light enters into a pair of the optical fibers mounted in the secondary reflecting mirror support section, the strain of each structural component is obtained by detecting the peak position of the interference pattern using the reflected light from the reflectors mounted in the tip of or in the optical fibers. It is thereby possible to measure the strain of the directional error caused by the displacement of the secondary reflecting mirror in real time. It is therefore possible to compensate the reflector surface error in real time by performing the feedback of the directional error to the antenna driving section. This operation can increase the compensation accuracy of the directional error.

Still further, according to the present invention, because the strain of the primary reflecting mirror back structure is measured using a pair of the optical fibers in the primary reflecting mirror back structure, it is possible to measure the directional error caused by the deformation of the primary reflecting mirror in real time, and further possible to increase the compensation accuracy of the directional error by performing the feedback of the directional error to the antenna driving section.

Moreover, according to the present invention, because the strain of the antenna mount section is measured using a pair of the optical fibers mounted in the antenna mount section, it is possible to calculate the directional error caused by the deformation of the antenna mount section. This can raise the limit for the mount position of the measuring devices and thereby enable to apply the measurement devices and the method disclosed in the present invention into the antennal apparatus of various types. In addition, by measuring the reflector surface error and the directional error are measured using the common optical fiber and the strain measurement section mounted in the antenna mount section, it is possible to measure the reflector surface error and the directional error simultaneously. This can obtain a simple system configuration of the antenna apparatus, and thereby increase the operation efficiency, and can decrease the entire cost of the antenna apparatus, the introduction time, and labor of the antenna apparatus.

While the above provides a full and complete disclosure of the preferred embodiments of the present invention, various modifications, alternate constructions and equivalents may be employed without departing from the scope of the invention. Therefore the above description and illustration should not be construed as limiting the scope of the invention, which is defined by the appended claims.

What is claimed is:

1. An antenna apparatus made up of a primary reflecting mirror, a secondary reflecting mirror, a secondary reflecting mirror support section, a back structure for the primary reflecting mirror, and an antenna mount section, comprising:

an optical fiber mounted in the primary reflecting mirror;

a strain measurement section for supplying a light to the optical fiber, detecting a scattered light transmitted from the optical fiber, and measuring a strain generated in the primary reflecting mirror;

a reflector surface error calculation section for calculating a reflector surface compensation data based on the strain generated in the primary reflecting mirror; and a reflector surface compensation section for compensating the reflector surface of the primary reflecting mirror based on the reflector surface compensation data.

2. The antenna apparatus according to claim 1, wherein the strain measurement section measures the strain generated in the sections in which the optical fiber is mounted by measuring a light strength shift amount and a frequency shift amount of the scattered light to the incident light of the optical fiber and by measuring a time length from the incident time of the light into the optical fiber to a received time of the scattered light.

3. An antenna apparatus made up of a primary reflecting mirror, a secondary reflecting mirror, a secondary reflecting mirror support section, a back structure for the primary reflecting mirror, and an antenna mount section, comprising:

an optical fiber mounted in the secondary reflecting mirror support section;

a strain measurement section for supplying a light to the optical fiber, detecting a scattered light transmitted from the optical fiber, and measuring a strain generated in the secondary reflecting mirror support section;

a directional error calculation section for calculating antenna directional compensation data based on the strain generated in the secondary reflecting mirror support section; and an antenna driving section for compensating the direction of an antenna based on the antenna directional compensation data.

4. The antenna apparatus according to claim 3, wherein the directional error calculation section further calculates secondary reflecting mirror position compensation data for compensating the directional error supplementary, and further comprises a secondary reflecting mirror driving section for compensating the position of the secondary reflecting mirror based on the secondary reflecting mirror position compensation data calculated.

5. An antenna apparatus made up of a primary reflecting mirror, a secondary reflecting mirror, a secondary reflecting mirror support section, a back structure for the primary reflecting mirror, and an antenna mount section, comprising:

an optical fiber mounted in the back structure;

a strain measurement section for supplying a light to the optical fiber, detecting a scattered light transmitted from the optical fiber, and measuring a strain generated in the back structure;

a directional error calculation section for calculating antenna directional compensation data based on the strain generated in the back structure; and an antenna driving section for compensating the direction of an antenna based on the antenna directional compensation data.

6. An antenna apparatus made up of a primary reflecting mirror, a secondary reflecting mirror, a secondary reflecting mirror support section, a back structure for the primary reflecting mirror, and an antenna mount section, comprising:

an optical fiber mounted in the antenna mount section;

a strain measurement section for supplying a light to the optical fiber, detecting a scattered light transmitted from the optical fiber, and measuring a strain generated in the antenna mount section;

a directional error calculation section for calculating antenna directional compensation data based on the strain generated in the antenna mount section; and an antenna driving section for compensating the direction of an antenna based on the antenna directional compensation data.

7. An antenna apparatus made up of a primary reflecting mirror, a secondary reflecting mirror, a secondary reflecting mirror support section, a back structure for the primary reflecting mirror, and an antenna mount section, comprising at least two of following combinations (A), (B), (C), and (D):

(A) an optical fiber mounted in the primary reflecting mirror;

a strain measurement section for supplying a light to the optical fiber, detecting a scattered light transmitted from the optical fiber, and measuring a strain generated in the primary reflecting mirror;

a reflector surface error calculation section for calculating a reflector surface compensation data based on the strain generated in the primary reflecting mirror; and a reflector surface compensation section for compensating the reflector surface of the primary reflecting mirror based on the reflector surface compensation data, (B) an optical fiber mounted on the secondary reflecting mirror support section;

a strain measurement section for supplying a light to the optical fiber, detecting a scattered light transmitted from the optical fiber, and measuring a strain generated in the secondary reflecting mirror support section;

a directional error calculation section for calculating antenna directional compensation data based on the strain generated in the secondary reflecting mirror support section; and an antenna driving section for compensating the direction of an antenna based on the antenna directional compensation data, (C) an optical fiber mounted on the back structure;

a strain measurement section for supplying a light to the optical fiber, detecting a scattered light transmitted from the optical fiber, and measuring a strain generated in the back structure;

a directional error calculation section for calculating antenna directional compensation data based on the strain generated in the back structure; and an antenna driving section for compensating the direction of an antenna based on the antenna. directional compensation data, and (D) an optical fiber mounted on the antenna mount section;

a strain measurement section for supplying a light to the optical fiber, detecting a scattered light transmitted from the optical fiber, and measuring a strain generated in the antenna mount section;

a directional error calculation section for calculating antenna directional compensation data based on the strain generated in the antenna mount section; and an antenna driving section for compensating the direction of an antenna based on the antenna directional compensation data.

8. An antenna apparatus made up of a primary reflecting mirror, a secondary reflecting mirror, a secondary reflecting mirror support section, a back structure for the primary reflecting mirror, and an antenna mount section, comprising:

an optical fiber mounted in the primary reflecting mirror, the secondary reflecting mirror support section, the back structure, and the antenna mount section;

a strain measurement section for supplying a light to the optical fiber, detecting a scattered light transmitted from the optical fiber, and measuring a strain generated in the primary reflecting mirror, a strain generated in the secondary reflecting mirror support section, a strain generated in the back structure, and a strain generated in the antenna mount section;

a reflector surface error calculation section for calculating a reflector surface compensation data based on the strain generated in the primary reflecting mirror;

a directional error calculation section for calculating antenna directional compensation data based on the strain generated in the secondary reflecting mirror support section, the strain generated in the back structure, and the strain generated in the antenna mount section; and an antenna driving section for compensating the direction of an antenna based on the antenna directional compensation data, wherein the optical fiber comprises first and second optical fibers, the first optical fiber is mounted in the primary reflecting mirror, the secondary reflecting mirror support section, and the back structure, and the second optical fiber is mounted in the antenna mount section, and the strain measurement section comprises first and second strain measurement sections, the first strain measurement section supplies a light to the first optical fiber, detects a scattered light transmitted from the first optical fiber, and measures the strain generated in the primary reflecting mirror, the strain generated in the secondary reflecting mirror support section, and the strain generated in the back structure, and the second strain measurement section supplies a light to the second optical fiber, detects a scattered light transmitted from the second optical fiber, and measures the strain generated in the antenna mount section.

9. The antenna apparatus according to claim 8, wherein the directional error calculation section further calculates secondary reflecting mirror position compensation data for compensating the directional error supplementary, and further comprises a secondary reflecting mirror driving section for compensating the position of the secondary reflecting mirror based on the secondary reflecting mirror position compensation data calculated.

10. The antenna apparatus according to claim 9, wherein the first strain measurement section measures the strain generated in the sections in which the first optical fiber is mounted by measuring a light strength shift amount and a frequency shift amount of the scattered light to the incident light of the first optical fiber and by measuring a time length from the incident time of the light into the first optical fiber to a received time of the scattered light, and the second strain measurement section measures the strain generated in the sections in which the second optical fiber is mounted by measuring a light strength shift amount and a frequency shift amount of the scattered light to the incident light of the second optical fiber and by measuring a time length from the incident time of the light into the second optical fiber to a received time of the scattered light.

11. An antenna apparatus made up of a primary reflecting mirror, a secondary reflecting mirror, a secondary reflecting mirror support section, a back structure for the primary reflecting mirror, and an antenna mount section, comprising:

a pair of optical fibers mounted in the primary reflecting mirror;

reflectors mounted at a tip of or in each optical fiber for reflecting an incident light;

a strain measurement section for supplying a light to the optical fibers, and measuring a strain generated in the primary reflecting mirror using the reflected light from the optical fibers;

a reflector surface error calculation section for calculating a reflector surface compensation data based on the strain generated in the primary reflecting mirror; and a reflector surface compensation section for compensating the reflector surface of the primary reflecting mirror based on the reflector surface compensation data.

12. An antenna apparatus made up of a primary reflecting mirror, a secondary reflecting mirror, a secondary reflecting mirror support section, a back structure for the primary reflecting mirror, and an antenna mount section, comprising:

a pair of optical fibers mounted in the secondary reflecting mirror support section;

reflectors mounted at a tip of or in each optical fiber for reflecting an incident light;

a strain measurement section for supplying a light to the optical fibers, and measuring a strain generated in the secondary reflecting mirror support section using the reflected light from the reflectors;

a directional error calculation section for calculating antenna directional compensation data based on the strain generated in the secondary reflecting mirror support section; and an antenna driving section for compensating the direction of an antenna based on the antenna directional compensation data.

13. The antenna apparatus according to claim 12, wherein the directional error calculation section further calculates secondary reflecting mirror position compensation data for compensating the directional error supplementary, and further comprises a secondary reflecting mirror driving section for compensating the position of the secondary reflecting mirror based on the secondary reflecting mirror position compensation data calculated.

14. An antenna apparatus made up of a primary reflecting mirror, a secondary reflecting mirror, a secondary reflecting mirror support section, a back structure for the primary reflecting mirror, and an antenna mount section, comprising:

a pair of optical fibers mounted in the back structure;

reflectors mounted at a tip of or in each optical fiber for reflecting an incident light;

a strain measurement section for supplying a light to the optical fibers, and measuring a strain generated in the back structure using the reflected light from the reflectors;

a directional error calculation section for calculating antenna directional compensation data based on the strain generated in the back structure; and an antenna driving section for compensating the direction of an antenna based on the antenna directional compensation data.

15. An antenna apparatus made up of a primary reflecting mirror, a secondary reflecting mirror, a secondary reflecting mirror support section, a back structure for the primary reflecting mirror, and an antenna mount section, comprising:

a pair of optical fibers mounted in the antenna mount section;

reflectors mounted at a tip of or in each optical fiber for reflecting an incident light;

a strain measurement section for supplying a light to the optical fibers, and measuring a strain generated in the antenna mount section using the reflected light from the reflectors;

a directional error calculation section for calculating antenna directional compensation data based on the strain generated in the antenna mount section; and an antenna driving section for compensating the direction of an antenna based on the antenna directional compensation data.

16. An antenna apparatus made up of a primary reflecting mirror, a secondary reflecting mirror, a secondary reflecting mirror support section, a back structure for the primary reflecting mirror, and an antenna mount section, comprising at least two of following combinations (A), (B), (C), and (D):

(A) a pair of optical fibers mounted in the primary reflecting mirror;

reflectors mounted at a tip of or in each optical fiber for reflecting an incident light;

a strain measurement section for supplying a light to the optical fibers, and measuring a strain generated in the primary reflecting mirror using the reflected light from the optical fibers;

a reflector surface error calculation section for calculating a reflector surface compensation data based on the strain generated in the primary reflecting mirror; and a reflector surface compensation section for compensating the reflector surface of the primary reflecting mirror based on the reflector surface compensation data, (B) a pair of optical fibers mounted in the secondary reflecting mirror support section;

reflectors mounted at a tip of or in each optical fiber reflects an incident light;

a strain measurement section for supplying a light to the optical fibers, and measuring a strain generated in the secondary reflecting mirror support section using the reflected light from the reflectors;

a directional error calculation section for calculating antenna directional compensation data based on the strain generated in the secondary reflecting mirror support section; and an antenna driving section for compensating the direction of an antenna based on the antenna directional compensation data, (C) a pair of optical fibers mounted in the back structure;

reflectors mounted at a tip of or in each optical fiber for reflecting an incident light;

a strain measurement section for supplying a light to the optical fibers, and measuring a strain generated in the back structure using the reflected light from the reflectors;

a directional error calculation section for calculating antenna directional compensation data based on the strain generated in the back structure; and an antenna driving section for compensating the direction of an antenna based on the antenna directional compensation data, and (D) a pair of optical fibers mounted in the antenna mount section;

reflectors mounted at a tip of or in each optical fiber for reflecting an incident light;

a strain measurement section for supplying a light to the optical fibers, and measuring a strain generated in the antenna mount section using the reflected light from the reflectors;

a directional error calculation section for calculating antenna directional compensation data based on the strain generated in the antenna mount section; and an antenna driving section for compensating the direction of an antenna based on the antenna directional compensation data.

17. An antenna apparatus made up of a primary reflecting mirror, a secondary reflecting mirror, a secondary reflecting mirror support section, a back structure for the primary reflecting mirror, and an antenna mount section, comprising:

four optical fibers made up of two pairs of optical fibers, having reflectors mounted at a tip of or in each optical fiber, for reflecting an incident light mounted in the primary reflecting mirror, the secondary reflecting mirror, the secondary reflecting mirror support section, and the back structure, and mounted in the antenna mount section;

strain measurement sections for supplying a light to the optical fibers, and measuring a strain generated in the primary reflecting mirror, a strain generated in the secondary reflecting mirror support section, a strain generated in the back structure, and a strain generated in the antenna mount section using the reflected light from the reflectors;

a reflector surface error calculation section for calculating a reflector surface compensation data based on the strain generated in the primary reflecting mirror;

a directional error calculation section for calculating antenna directional compensation data based on the strain generated in the secondary reflecting mirror support section, the strain generated in the back structure, and the strain generated in the antenna mount section; and an antenna driving section for compensating the direction of an antenna based on the antenna directional compensation data, wherein the optical fibers comprises first, second, third and fourth optical fibers, the first and second optical fibers are mounted in the primary reflecting mirror, the secondary reflecting mirror support section, and the back structure, and the third and fourth optical fibers are mounted in the antenna mount section, and the strain measurement sections comprises first and second strain measurement sections, the first strain measurement section supplies a light to the first and second optical fibers, detects a reflected light, reflected by the reflectors, transmitted from the first and second optical fibers, and measures the strains generated in the primary reflecting mirror, the secondary reflecting mirror support section, and the back structure, and the second strain measurement section supplies a light to the third and fourth optical fibers, detects a reflected light, reflected by the reflectors, transmitted from the third and fourth optical fibers, and measures the strain generated in the antenna mount section.

18. The antenna apparatus according to claim 17, wherein the directional error calculation section further calculates secondary reflecting mirror position compensation data for compensating the directional error supplementary, and further comprises a secondary reflecting mirror driving section for compensating the position of the secondary reflecting mirror based on the secondary reflecting mirror position compensation data calculated.

* * * * *